US010661110B2

(12) United States Patent
Schwandt

(10) Patent No.: US 10,661,110 B2
(45) Date of Patent: May 26, 2020

(54) CLOTH BACK SUPPORT APPARATUS AND METHODS OF USE

(71) Applicant: Kara Marie Schwandt, North Vancouver (CA)

(72) Inventor: Kara Marie Schwandt, North Vancouver (CA)

(73) Assignee: Kara Schwandt, North Vancouver, BC (CA)

( * ) Notice: Subject to any disclaimer, the term of this patent is extended or adjusted under 35 U.S.C. 154(b) by 396 days.

(21) Appl. No.: 15/451,299

(22) Filed: Mar. 6, 2017

(65) Prior Publication Data

US 2018/0250542 A1 Sep. 6, 2018
US 2020/0023219 A9 Jan. 23, 2020

Related U.S. Application Data

(63) Continuation of application No. 14/847,007, filed on Sep. 8, 2015, now Pat. No. 9,656,113.

(60) Provisional application No. 62/057,271, filed on Sep. 30, 2014.

(30) Foreign Application Priority Data

Sep. 29, 2014 (CA) ..... 2866041

(51) Int. Cl.

| | |
|---|---|
| ***A63B 21/002*** | (2006.01) |
| ***A41D 23/00*** | (2006.01) |
| ***A63B 71/00*** | (2006.01) |
| ***A45F 3/14*** | (2006.01) |
| ***A41D 15/04*** | (2006.01) |
| *A63B 69/00* | (2006.01) |

(52) U.S. Cl.

CPC ..... *A63B 21/0023* (2013.01); *A41D 15/04* (2013.01); *A41D 23/00* (2013.01); *A45F 3/14* (2013.01); *A63B 71/0036* (2013.01); *A45F 2003/142* (2013.01); *A45F 2200/0566* (2013.01); *A63B 69/0059* (2013.01)

(58) Field of Classification Search

CPC . A63B 21/002; A63B 21/0023; A63B 21/065; A41D 23/00

See application file for complete search history.

(56) References Cited

U.S. PATENT DOCUMENTS

| | | | | |
|---|---|---|---|---|
| 2,287,887 A | | 6/1942 | Kramer | |
| 3,748,661 A | | 7/1973 | Smith | |
| 3,890,004 A | | 6/1975 | Rail | |
| 4,394,049 A | | 7/1983 | Ward | |
| 4,627,109 A | * | 12/1986 | Carabelli | A61F 5/028 2/300 |
| 4,773,106 A | * | 9/1988 | Toso | A47C 16/00 297/464 |

(Continued)

*Primary Examiner* — Joshua T Kennedy

(57) ABSTRACT

A back support apparatus which includes a length of cloth consisting of a tail, body and buckle; the tail and buckle join to form a loop inside which a user sits. The apparatus and method of use stabilize a user in a seated position. The method of use is as follows: the cloth is wrapped around the users back and knees while in a seated, crossed leg position, and the tail threaded through the buckle and cinched tight in front of the users body. The apparatus is adjusted by pulling the tail further through the buckle, increasing support, or pulling the buckle away from the user's body, releasing tension.

14 Claims, 24 Drawing Sheets

(56) References Cited

U.S. PATENT DOCUMENTS 4,934,005 A * 6/1990 Martin ..... A47C 16/00 5/652
5,001,791 A 3/1991 Toso
5,083,554 A * 1/1992 Toso ..... A47C 16/00 297/464
5,643,184 A 7/1997 Toso
5,857,598 A * 1/1999 Dunne ..... A47D 13/025 224/158
5,950,887 A * 9/1999 Powell ..... A47D 13/025 224/158
6,083,183 A * 7/2000 Yang ..... A61F 5/028 128/876
7,231,670 B2 6/2007 Chang
7,628,465 B2 12/2009 Brodeur
D630,838 S * 1/2011 Gmeiner ..... D3/214
8,038,584 B1 10/2011 Pruessner et al.
8,590,974 B2 11/2013 Kalayjian
8,783,530 B1 7/2014 Jordan
9,656,113 B2 * 5/2017 Schwandt ..... A41D 15/04
2005/0239604 A1 10/2005 Denham
2006/0052222 A1 3/2006 Cardenas
2006/0157525 A1 7/2006 Furlong
2006/0237493 A1 * 10/2006 Tsai ..... A47D 13/025 224/159
2006/0283205 A1 12/2006 Carriere
2007/0033706 A1 * 2/2007 Kuhlmann ..... A41D 23/00 2/207
2007/0062989 A1 3/2007 Kassai
2007/0066467 A1 3/2007 Edwards
2007/0173382 A1 * 7/2007 Axelrod ..... A63B 21/0004 482/91
2008/0116239 A1 * 5/2008 Lu ..... A45C 13/30 224/575
2008/0229501 A1 9/2008 Hutchison
2009/0197747 A1 8/2009 Chan
2010/0032537 A1 * 2/2010 Andrews ..... A45F 3/14 248/342
2011/0131723 A1 6/2011 Andrews
2012/0043355 A1 2/2012 Cook
2012/0248159 A1 10/2012 Rahni
2013/0047316 A1 2/2013 Gillan
2014/0026292 A1 * 1/2014 Wosu ..... A41D 23/00 2/207
2014/0084031 A1 3/2014 Bowden
2014/0089970 A1 3/2014 Thomas
2014/0215687 A1 8/2014 Andrews
2014/0215587 A1 9/2014 Knight
2014/0311635 A1 * 10/2014 MacDonald ..... A45F 3/02 150/102
2015/0189997 A1 * 7/2015 Gmeiner ..... A47D 13/02 224/158

* cited by examiner

CLOTH BACK SUPPORT APPARATUS AND METHODS OF USE

FIELD OF THE INVENTION

Meditation is the practice of mindfully observing one's thoughts, emotions, and the physical body. Most often meditation is practiced while sitting with the legs crossed and maintaining a straight spine.

Practitioners often complain about discomfort felt when sitting in the aforementioned posture, however this posture is the most conducive to meditation. Some practitioners argue this posture prevents one from obtaining a deep and mindful practice due to physical distraction and frustration.

The goal of meditation is to move beyond the attachment to thought and simple observation of the mind. Practitioners find difficulty in achieving such states of awareness when the physical body feels taxed. The mind becomes attached to the physical pain and therefore cannot move to simple observation of the experience and associated emotions.

DESCRIPTION OF THE PRIOR ART

Many known meditation aids unfortunately are rigid, hard and/or stationary. Thus, many are only useful when practicing in a designated location (IE the user's home or sanctuary) as they do not readily travel or are cumbersome.

In addition, these aids are useful for sitting in only one or two position. Such are described, for example, in U.S. Pat. Nos. 7,628,455 and 3,890,004. In operation, the prior art requires a stable surface and does not transport easily. Other apparatus's such as U.S. Pat. Nos. 8,590,974 B2 and 4,394,049 are comprised of rigid materials and thus can be used in only one position. The present invention is compact, soft and flexible in nature.

Many known portable back support apparatus's exist, however are complex or tangle easily. Such are described, for example, in U.S. Pat. Nos. 5,643,184 and 5,001,791. In operation, the prior art is complex to figure out and the straps tangle easily.

There remains a need for a soft, flexible and easy to use portable back support.

BACKGROUND OF THE INVENTION

This application is a continuation of application Ser. No. 14/847,007, filed Sep. 8, 2015, which claims the benefit of U.S. Provisional Application No. 62/057,271, filed Sep. 30, 2014. The present invention was devised during a silent meditation retreat in which the inventor sat in meditation for 10 hours per day for 10 days. The present invention is a length of cloth consisting of a tail, body and buckle; the tail and buckle join to form a loop inside which a user sits. The apparatus and method of use stabilize a user in a seated position. The method of use is as follows: the cloth is wrapped around the user's back and knees while in a seated, crossed leg position, and the tail threaded through the buckle and cinched tight in front of the users body. The apparatus is adjusted by pulling the tail further through the buckle, increasing support, or pulling the buckle away from the user's body releasing tension.

The present invention relates to a back support apparatus for supporting a user's mid to low back, and a methodology for a user to sit in a simple cross-legged position, while supporting the spine following proper placement of the present invention around a user's back.

The present invention and method aids a user in achieving a comfortable seated position with proper placement of the apparatus around a user's back and knees. The practitioner's knees are either down towards the ground or up in a more relaxed position, or other variations known to persons skilled at sitting for long periods of time. The apparatus is worn flat to cover the entire upper and mid back range, or folded, scrunched, knotted or twisted providing a more focused area of support and placed along any part of the spinal range of the upper, mid or low back. The present invention provides an easy and transportable apparatus with a simple method of obtaining a comfortable seat.

The preferred embodiment of the present invention along with a methodology of use is to aid a practitioner sitting in meditation or a user attending concerts, festivals, the beach, a park, camping or other activities where a user requires additional back support. The present invention is used as a method to obtain physical support of the lower lumbar spine and mid back so a user may enjoy a deeper meditative experience or the outdoors in comfort.

It is an object of the present invention and method to provide back support and comfort to a practitioner of meditation while seated with crossed legs. Further, the present invention and method accommodate a variety of users, from novice to advanced practitioner and most body shapes and sizes.

In addition, the present invention and method act as a physical support to a practitioner of yoga.

The present invention and method functions as a hip opener in prenatal care to prepare a user's body for child birth.

Additionally, the present invention may be used to carry a yoga mat.

It is another object of the present invention to provide an easily transportable unit which is used in a variety of atmospheres and settings. The present invention's method of use is supporting a practitioners' physical body in meditation, be it at home, the park, a meditation center or yoga studio.

It is a further object of the present invention to provide an easily transportable unit which provides comfort and back support to a user sitting at festivals, concerts, the park, beach, camping or any location a user may sit with the spine unsupported.

The present invention is a cloth apparatus (20) having a buckle at the first end (2) and a tail at the second end (4). The cloth is comprised of woven or knit fibers containing little to no stretch, such as but not limited to: cotton, linen, recycled polyester, hemp and may contain lycra, spandex or elastin.

In the preferred first embodiment of the present invention the apparatus is buckled together using two circular rings. The buckle may alternately be comprised of a conventional buckle, 'D' shaped rings or rectangular hardware, however are not restricted to the aforementioned.

The present invention is secured around a user in a crossed leg position by pulling the tail through the buckle, placing the loop around a user's knees and back, encircling the lower body and tightening the back support by pulling the tail end further through the buckle.

The present invention derives strength from folds in the cloth and securing the buckle to the body with reinforced stitching, however the buckle may be secured in other embodiments with latches, fasteners, locking snaps, however is not limited to the aforementioned; and in other embodiments the cloth remains unfolded prior to securing the buckle the length of cloth.

The preferred method of use of the present invention is aiding a practitioner of meditation in sitting with crossed legs and a straight spine. The apparatus is used alone or in conjunction with other meditation props, such as bolsters, blocks or cushions.

The first embodiment of the present invention uses the back support apparatus to aid a practitioner of meditation in achieving a comfortable seat while maintaining proper posture through correct placement of said apparatus upon a user's back and knees while sitting. The practitioner forms a loop with the apparatus which encircles the users' back and knees while seated with crossed legs. This is accomplished by weaving the tail through both buckles and then back through the furthest ring only. The user pulls the tail to form the desired loop size inside which to sit and places the formed loop on the surface of which to sit with the buckle in front of the body and proceeds to sit inside the loop in a crossed legged position using both hands to place the cloth across the back and around the knees. The knees act as a fulcrum point placing tension upon the cloth around the practitioner's back and pulling the spine into proper alignment. The cloth is adjusted vertically up or down a user's knees, which equally translates to the pressure upon a user's back. The apparatus may be worn flat covering the entire low to mid back range; or folded, scrunched, knotted or twisted providing a more focused area of support. Due to the present inventions ease of use and little to no elasticity, a practitioner is provided with a simple way to properly align the spine without a great deal of adjustment.

The second embodiment of the present invention uses the apparatus to obtain a comfortable seat while a user attends festivals, concerts or an event where a user must sit upon a surface with the spine unsupported. Such surfaces include but are not restricted to: the ground or floor, a meditation cushion, a block, bolster, cushion, a backless bench, bleachers or stool.

The third embodiment of the present invention aids a user in supporting the body when using the apparatus for prenatal care. The apparatus supports a user while seated with crossed legs or with the soles of the feet together in butterfly pose assisting the body in preparation for natural childbirth by pushing the uterus forward and stretching the cartilage and ligaments at the sacroiliac joints and front of the symphysis pubis bone which open the pelvis and stretch the legs.

The fourth embodiment of the present invention demonstrates a practitioner using the apparatus when practicing yoga. Such yoga postures in which to use the present invention and method include, but are not limited to: sitting with crossed-legs (sukasana, lotus pose, easy pose), butterfly pose, reclining butterfly pose, spinal twist with bent knees, seated forward fold with legs outstretched, knees to chest and other variations as would be known to a person skilled or knowledgeable in the art of yoga or stretching, and the latter postures as known by any other names.

The fifth embodiment of the present invention describes a user wearing the apparatus as a scarf. The present invention is worn as a scarf to keep a user warm. A user wears the present invention as a scarf by weaving the tail through the buckle 4-10" and looping the cloth around a user's neck 1 or more times depending on the users desired level of comfort.

The sixth embodiment of the present invention describes a user wearing the apparatus as a shawl. The present invention is worn as a shawl to protect a user's skin from sun or to keep warm. A user wears the present invention as a shawl by draping the cloth over the shoulders then securing the tail end through the buckle and tightening to maintain placement.

The seventh embodiment of the present invention includes a pocket to support an iPod or other audio device such as, but not limited to, a smart phone, iPod or iPhone to listen to guided meditations or music while using the invention as described in any of the previous embodiments. The present invention's pockets are placed at the inventors' discretion.

The eighth embodiment of the present invention is fabricated from cloth material in multiple layers and contain pockets or placements for hot or cold therapy packs, healing stones, gems, aromatherapy packs, herbal packs and poultices or other healing aids.

The ninth embodiment of the present invention is a method for carrying a yoga mat. The tail of the apparatus is threaded through the buckle leaving a small circle which is placed around one end of a rolled up yoga mat and the cloth is cinched tight. The tail of the apparatus is then tied around the opposite end of the rolled up yoga mat. This creates a strap which a user can wear over one shoulder or slung across the back.

BRIEF DESCRIPTION OF THE DRAWINGS

In illustrations and demonstrations of embodiments of the present invention:

FIG. 1A shows the front of the apparatus with the buckle depicted as 2 circular rings (2), a rounded tail (4) and reinforced double stitching (3) to secure the buckle to the cloth; FIG. 1B shows the back of the apparatus detailing the folds of cloth (5) and placement of the buckle (2) with reinforced double stitching (3).

SUMMARY OF THE INVENTION

Figure 1A:
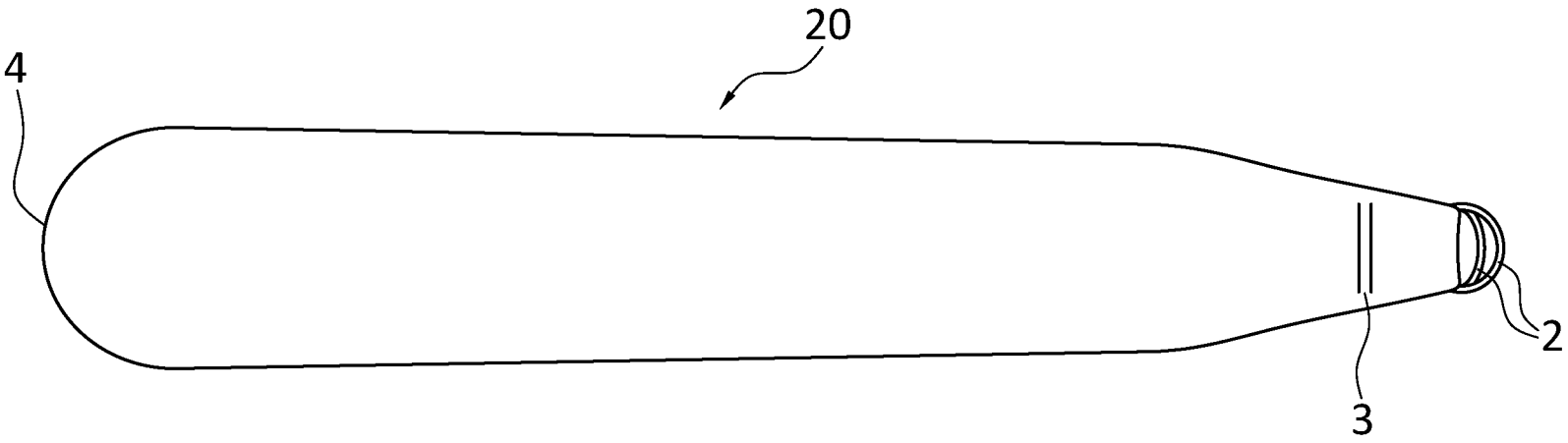
FIGS. 1A and 1B are isometric views of a cloth back support apparatus (20) according to a preferred first embodiment of the present invention.

The following description should be read with reference to the drawings, in which like elements in different drawings are numbered in like fashion. The drawings which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The drawings in FIGS. 1A, 1B, 2A, 2B, 3A, 3B, 3C, 3D, 3E and 4A, 4B, 4C, 4D and 4E illustrate the preferred first embodiments of the present invention.

The present invention as shown in FIGS. 1 through 10 is an apparatus (20) consisting of a length of cloth having a first buckle end (2) and a second tail end (4). The buckle is securely fastened with reinforced stitching (3) at the first end. For the purposes of this document, the buckle will be depicted as 2 circular rings (2) secured to the first end with two rows of reinforced stitching (3).

Alternately, the buckle (2) of the present invention (20) may be constructed of materials such as, but not restricted to, metal, nylon or plastic, in a round, oval, square, oblong or 'D' shapes and in varying sizes and quantities, which those skilled in the art will see as a suitable alternatives.

Alternately, the buckle (2) of the present invention (20) may be secured by way of locking fasteners, snaps, latches or other secure locking mechanism those skilled in the art will recognize as suitable alternatives.

Figure 1B:
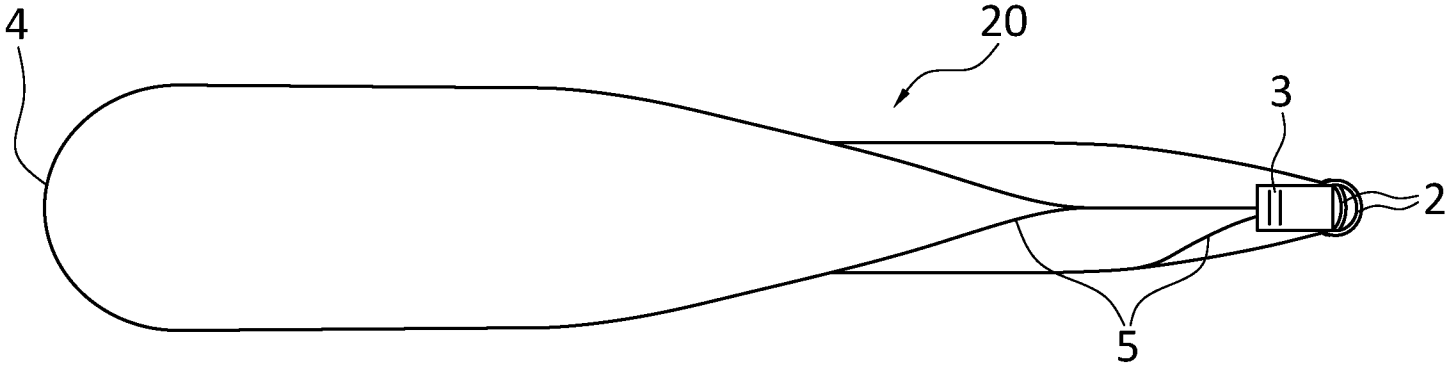

Referring now to FIGS. 1A and 1B, which illustrate the basic layout of the first embodiment of the present invention (20) showing the tail end (4), buckle (2) and means of securing the buckle (3). The present invention (20) is shown from the front in FIG. 1A, and from the back as shown in FIG. 1B. FIG. 1B details the folds of the cloth (5) in the preferred first embodiment of the invention.

Figure 2A:
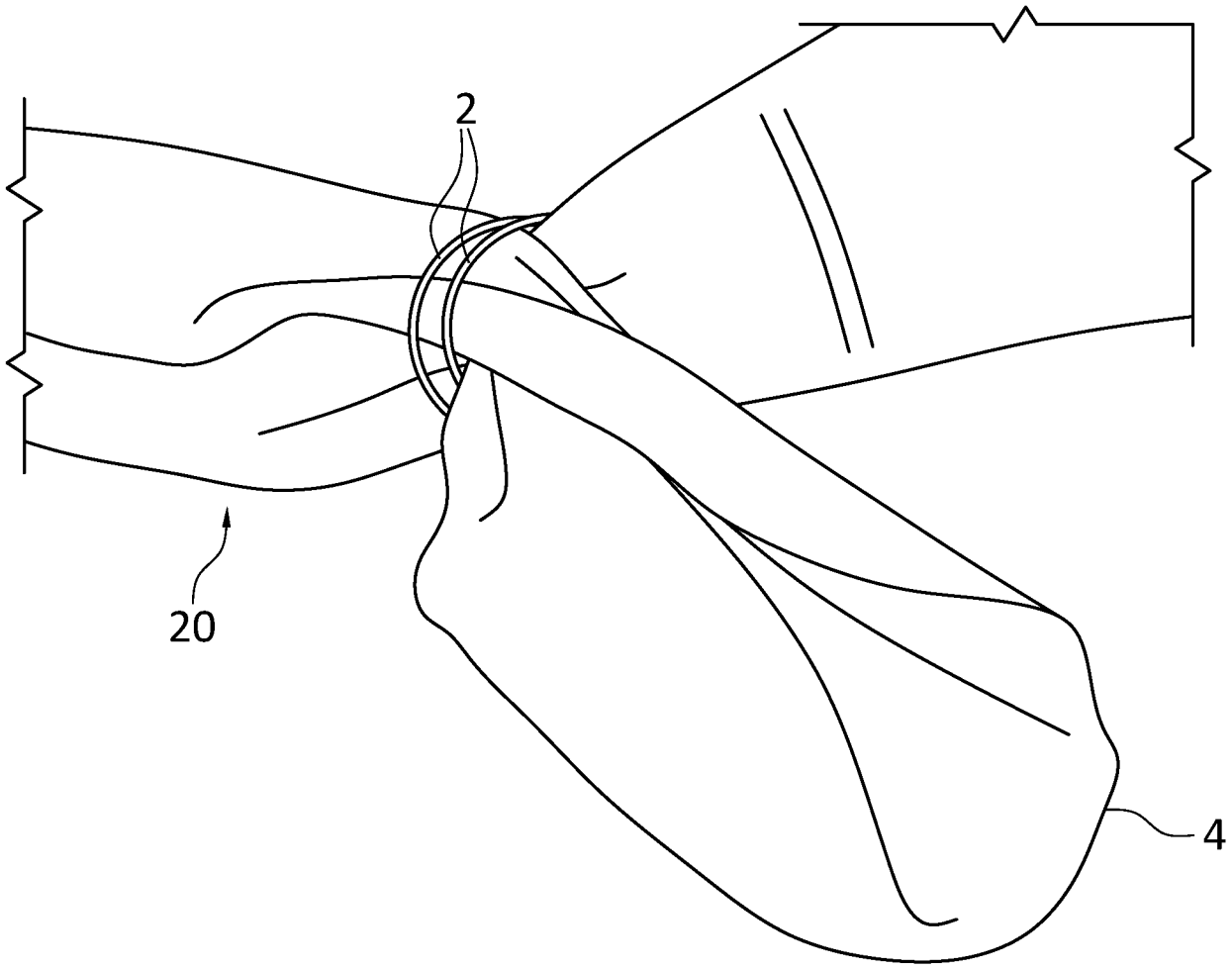
FIGS. 2A and 2B are perspective views of a preferred first embodiment of the present invention detailing a two-step process for assembling the back support apparatus.
Figure 2B:
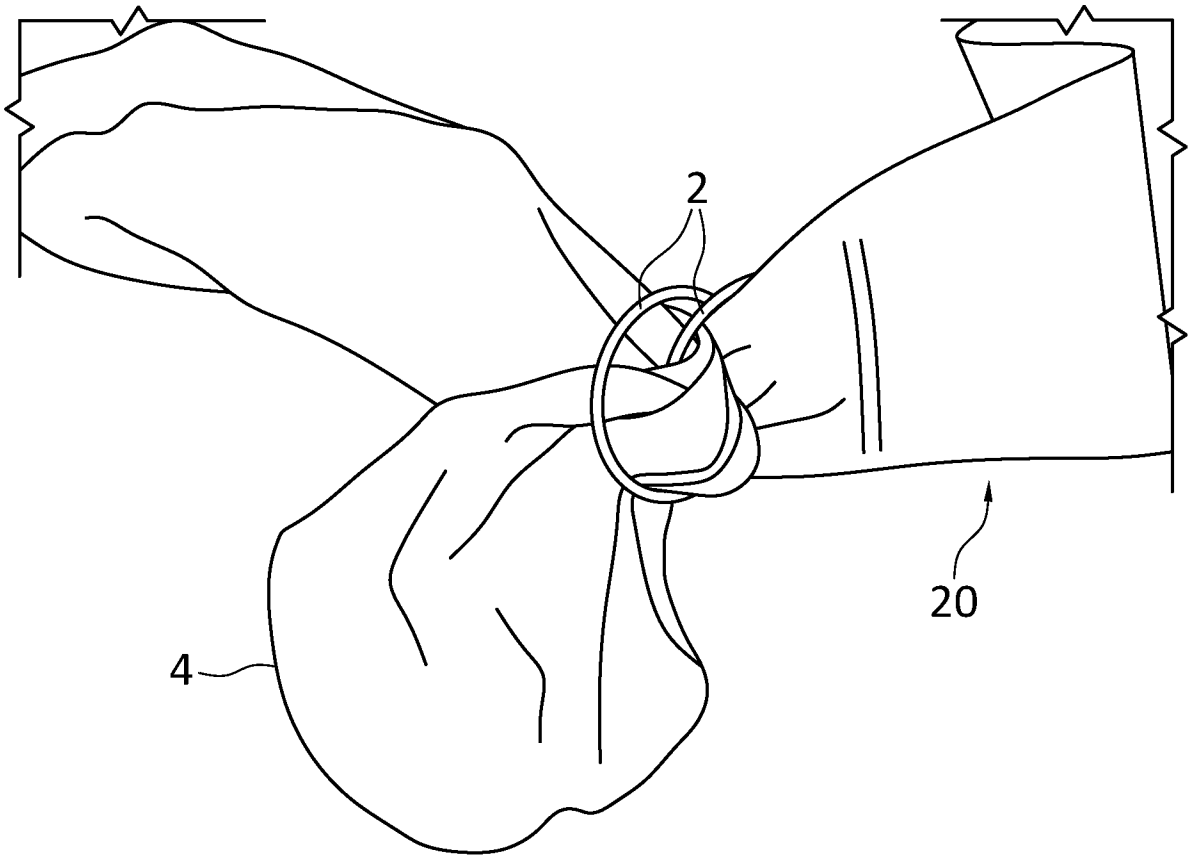

Referring now to FIGS. 2A and 2B, which detail the preferred first embodiment of the present invention's means of closure via a buckle (2) comprised of 2 circular rings. The figures detail a two-step process of securely fastening the apparatus (20). First weave the cloth tail through both rings (2) as shown in FIG. 2A, then weave the tail through the furthest ring (2) only as shown in FIG. 2B. Pulling the tail (4) adjusts the loop size and tension upon a user's body.

Figure 3A:
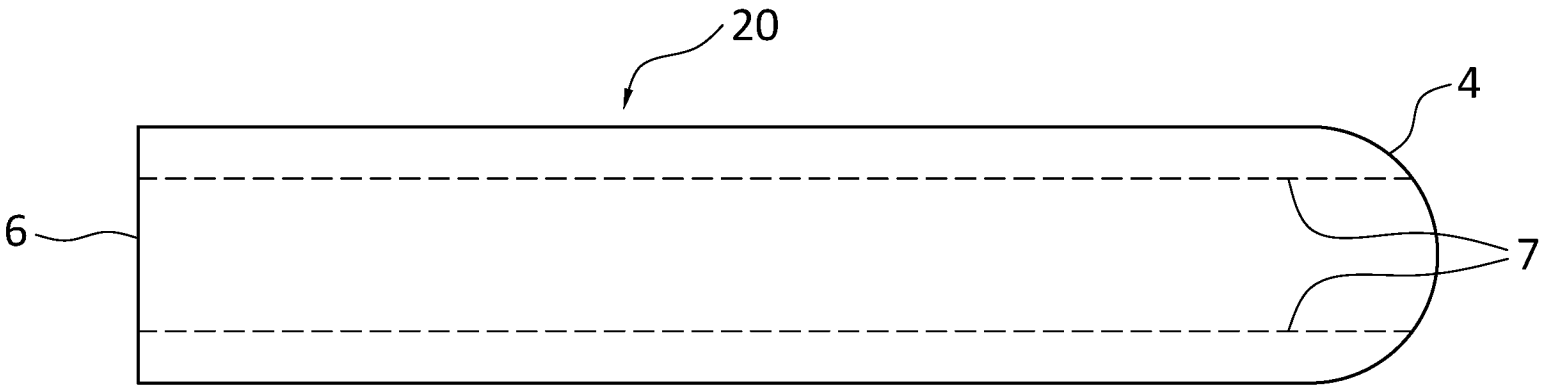
FIGS. 3A through 3E are a series of plan views showing a method for manufacturing the present invention.
Figure 3B:
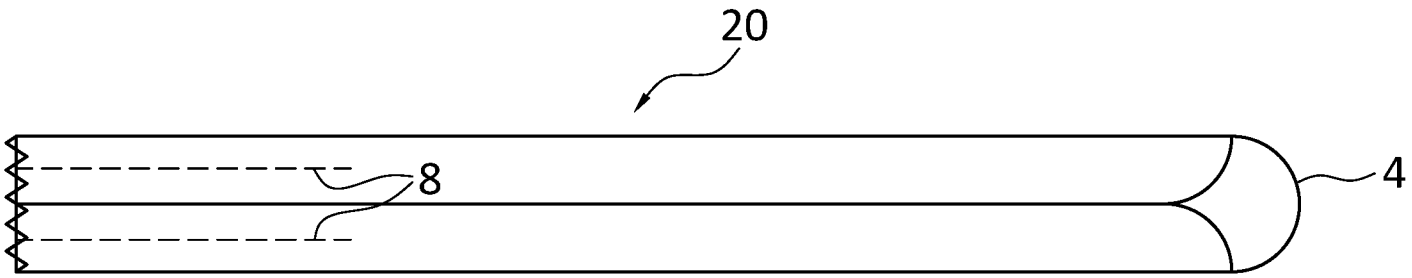
Figure 3C:
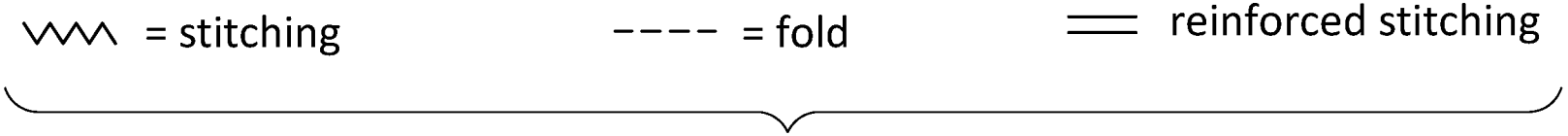
Figure 3D:
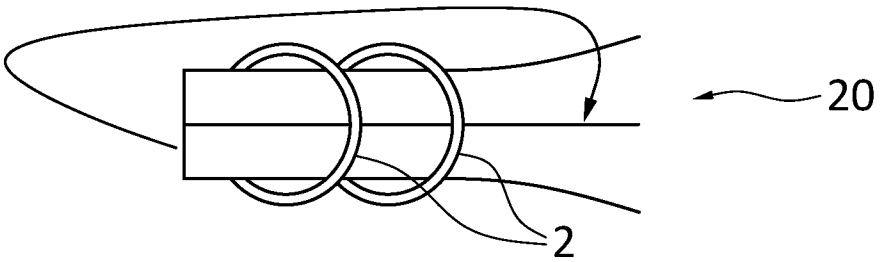
Figure 3E:
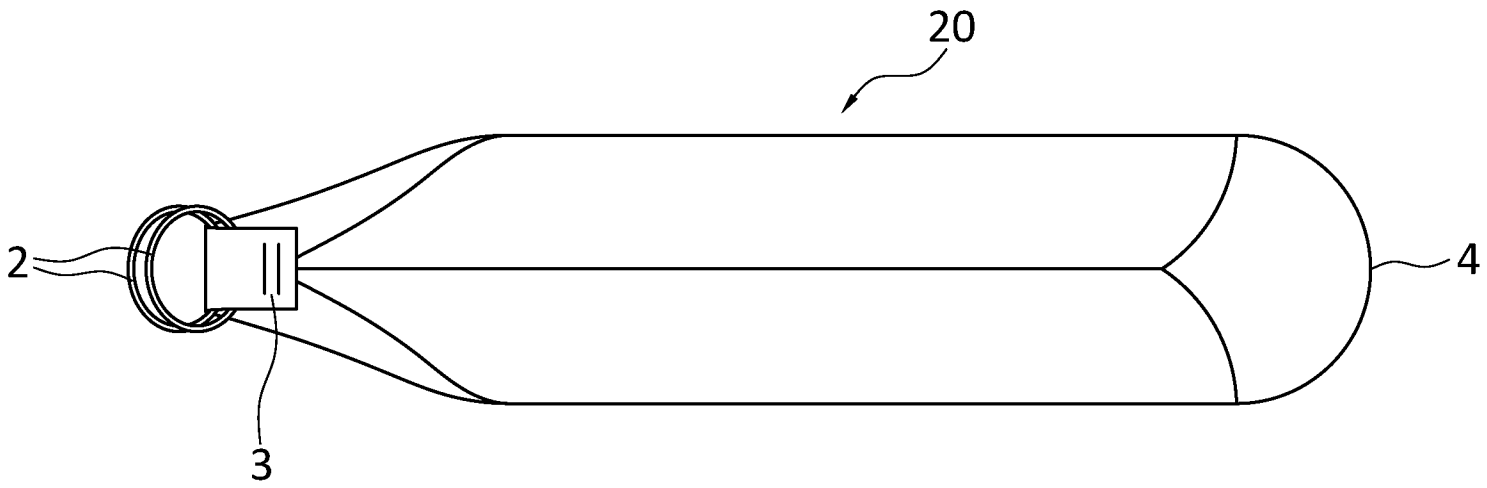

Referring now to FIGS. 3A through 3E, a series of plan views which illustrate the steps required to produce the present invention (20) in its preferred first embodiment (FIGS. 1A and 1B). FIG. 3A shows the cloth in its first cut stage with a rounded tail (4), squared end (6) and 2 fold lines (7). FIG. 3B shows the cloth folded into the center point and stitched together at the squared end. Two additional marks indicate where the sides fold again towards the center line (8). FIG. 3C is a legend for stitch marks, fold lines and secure/reinforced stitching. FIG. 3D shows the folded cloth inserted through the two rings (2) and folds over said rings as indicated by the arrows. FIG. 3E shows the cloth folded over, and the rings (2) stitched securely into place with a double line of reinforced stitching (3). This is the basic layout of the first embodiment of the present invention (20).

Figure 4A:
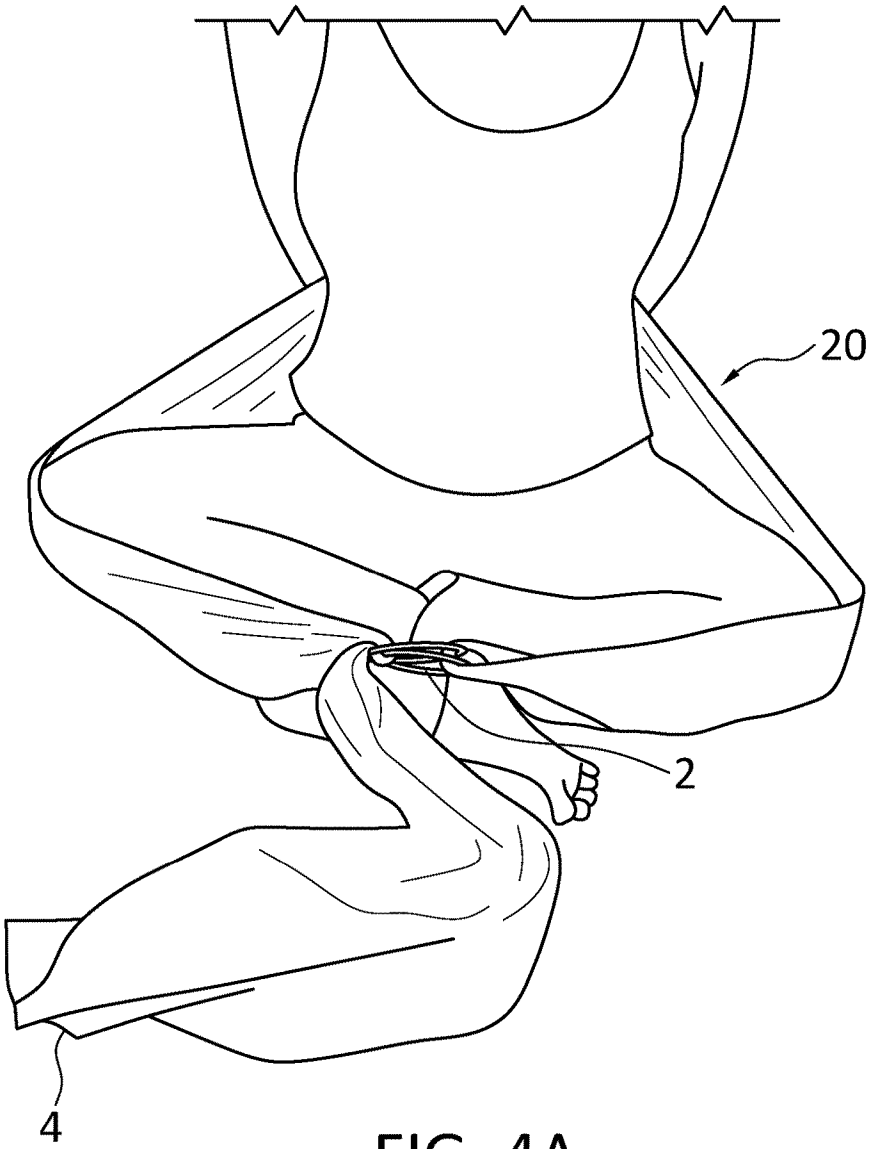
FIGS. 4A through 4E illustrate the method of a preferred first embodiment of the present invention for sitting with crossed legs.
Figure 4B:
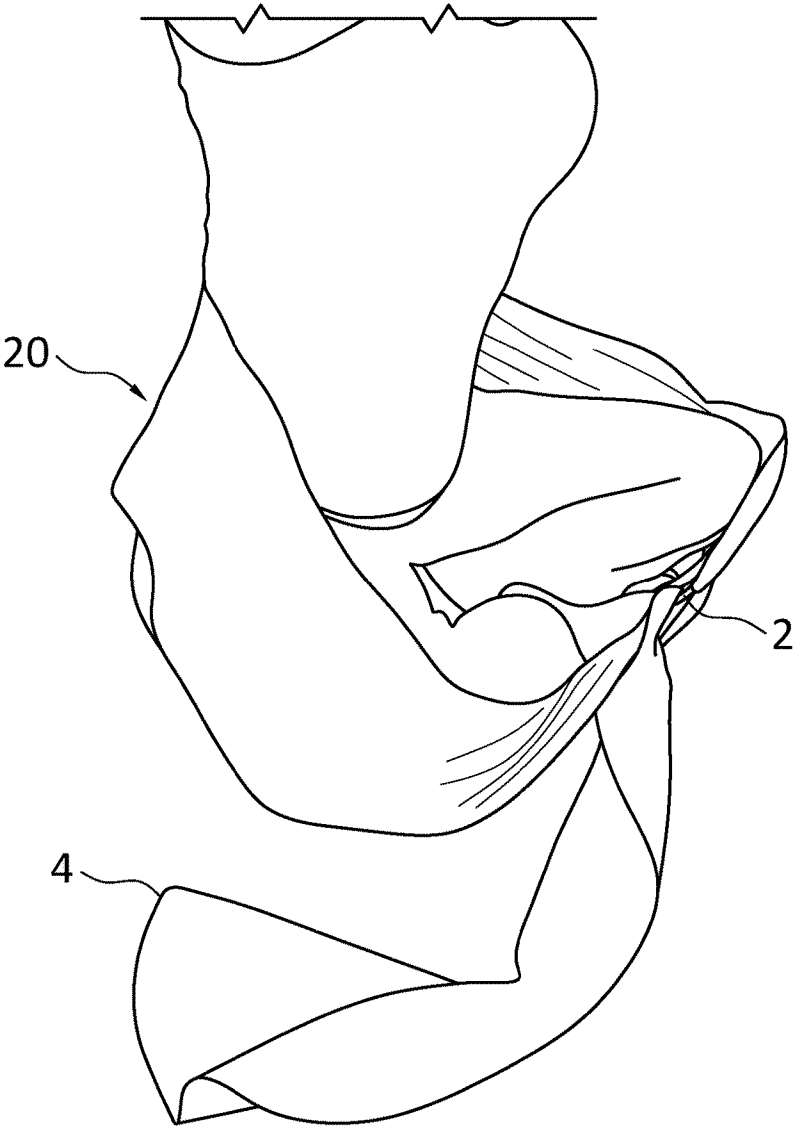
Figure 4C:
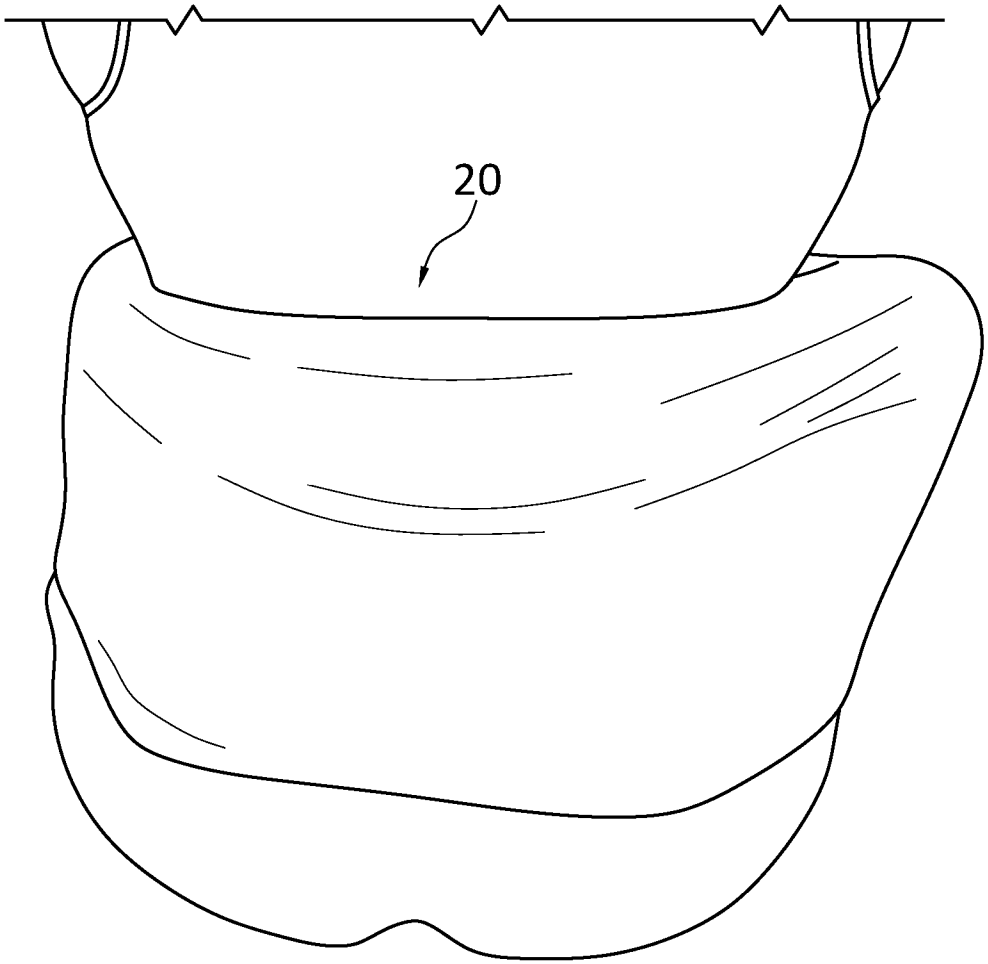
Figure 4D:
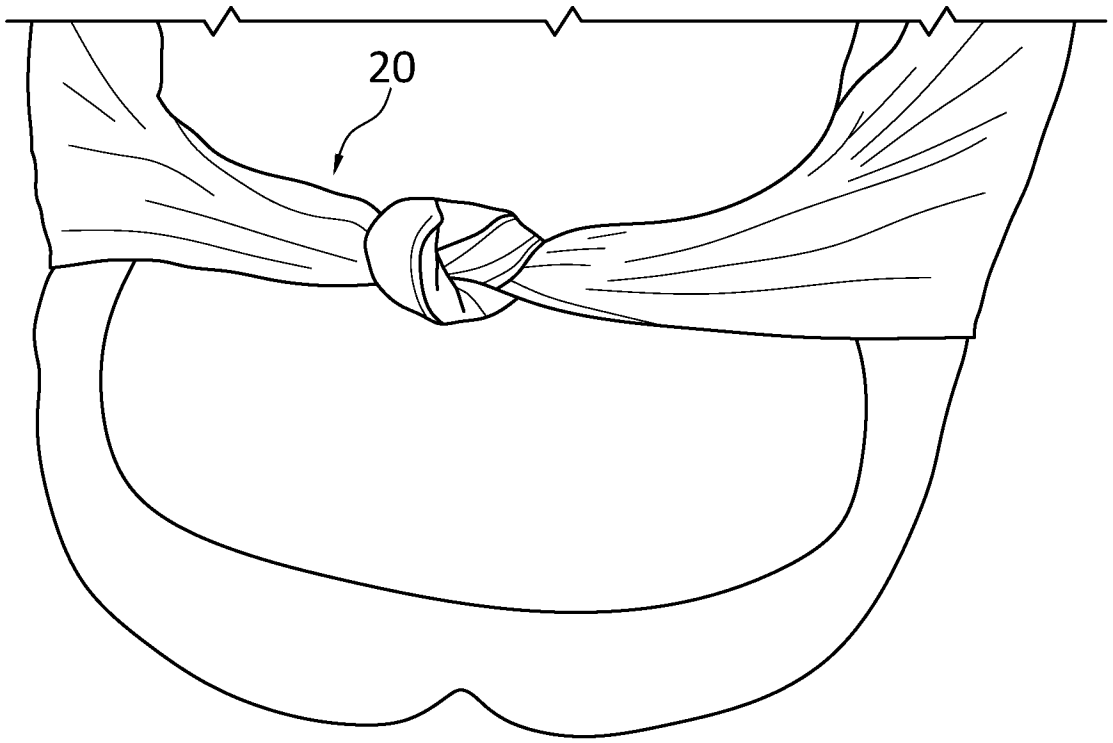
Figure 4E:
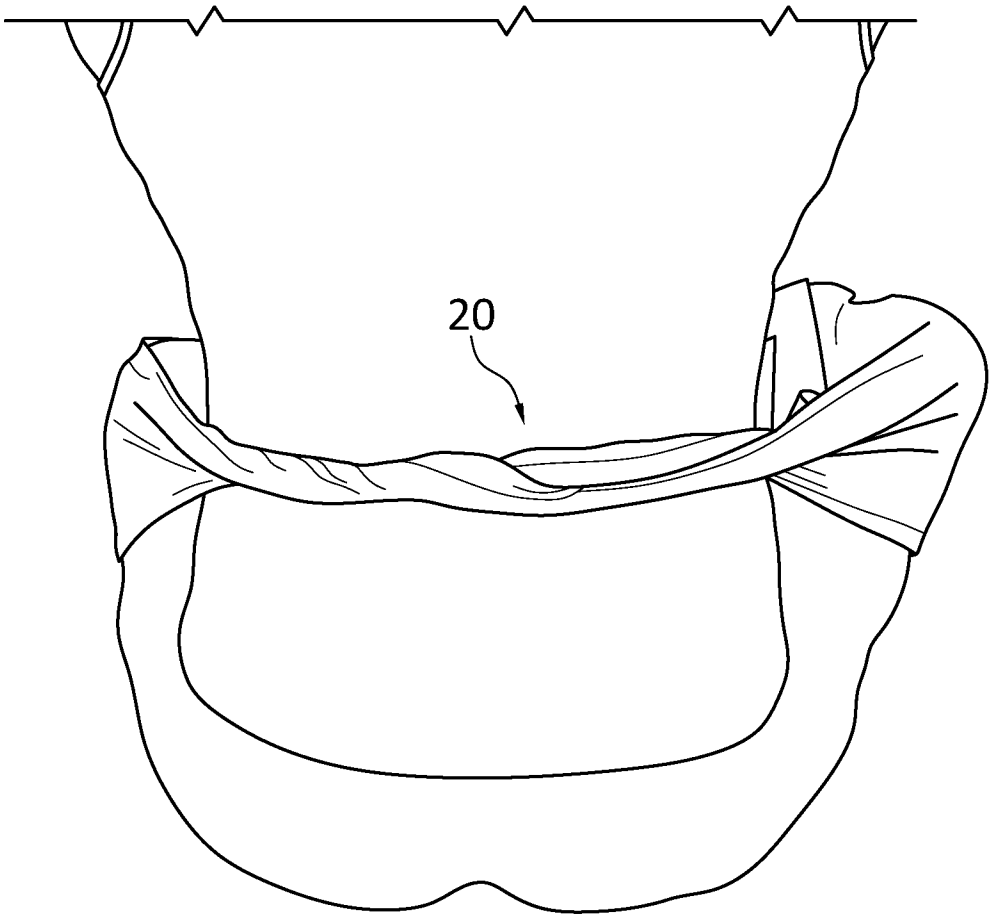

The following refers to FIGS. 4A and 4B in the first embodiment of the present invention (20) as a method used to sit in meditation. The tail end (4) is woven through the buckle (2), then loops back and is threaded through the furthest ring only (2) (FIGS. 2A and 2B). A user pulls the tail (4) to form the desired loop size inside which to sit. The user places the formed loop on the surface of which to sit with the buckle (2) in front of the body and proceeds to sit inside the circular loop in a crossed legged position using both hands to place the cloth across the users back and around the knees. A user pulls the tail end (4) which places tension upon the cloth around the knees and back, pulling the cloth closer but not tight. A user then lifts up the knees a few inches while pulling the tail end (4) through the buckle (2), allowing the loop to further envelop the body, then relaxes the knees down and further adjust the cloth over the knees. Pulling the cloth up or down at the knees directly affects the tension felt across the back. FIGS. 4A and 4B illustrate a straight spine conducive to meditation.

The back support apparatus (20) is worn flat across the back to cover the entire low to mid back range (FIG. 4C), or is knotted (FIG. 4D), twisted (FIG. 4E), folded or scrunched to provide a more focused area of support which is placed at any point on a user's back. The user adjusts the cloth across the back finding a comfortable placement of pressure before relaxing into the final posture which has pulled the spine into proper alignment.

Referring again to FIGS. 4A and 4B wherein the invention (20) is used as an aid and method for supporting the body in prenatal care in the third embodiment. The crossed leg posture pushes the uterus forward, stretches the legs and opens the pelvis by stretching the cartilage and ligaments at the sacroiliac joints and the front symphysis pubis bone allowing the pelvic cartilage and ligaments to relax and open. The method of use is described herein.

Figure 5:
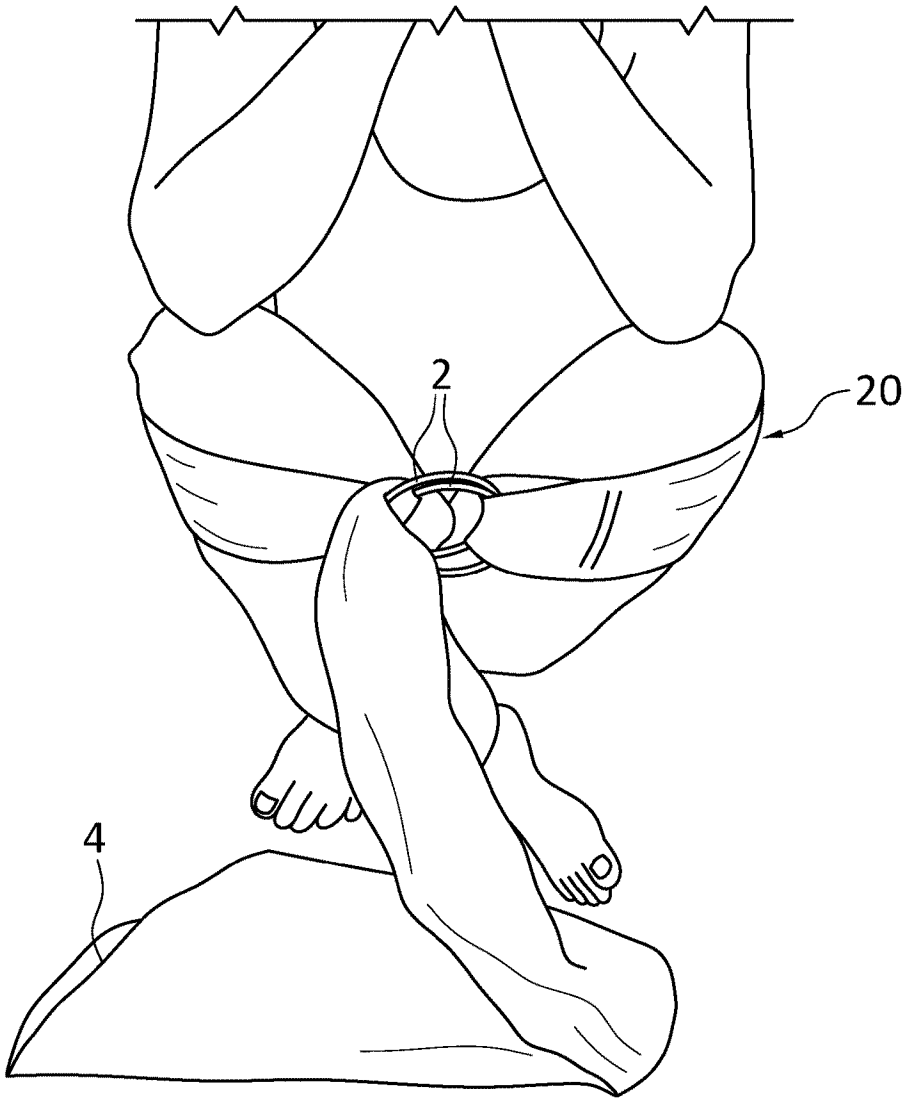
FIG. 5 illustrates the method of use in the second embodiment of the present invention while sitting at a festival, concert or other event where the user is seated on a surface without back support.

Referring now to FIG. 5, the method of use in the second embodiment of the present invention (20) at concerts, festivals, the beach, park, camping or other activity where a user is seated with the back unsupported. A user creates a loop with the apparatus and proceeds to sit inside said loop as described previously herein. A user then maneuvers the cloth apparatus (20) across the back and around the shins while the knees are bent, bringing them in towards the chest and torso (FIG. 5). The shins act as a fulcrum placing tension upon the cloth apparatus (20) around a user's back, supporting a comfortable and relaxed upright position. A user pulls the tail end (4) through the buckle placing tension upon the cloth around the back and envelops the body. The back support apparatus (20) may be worn flat across the users back (FIG. 4C), knotted (FIG. 4D), twisted (FIG. 4E, folded or scrunched. The user then relaxes the knees and back into the cloth finding a comfortable position.

Figure 6A:
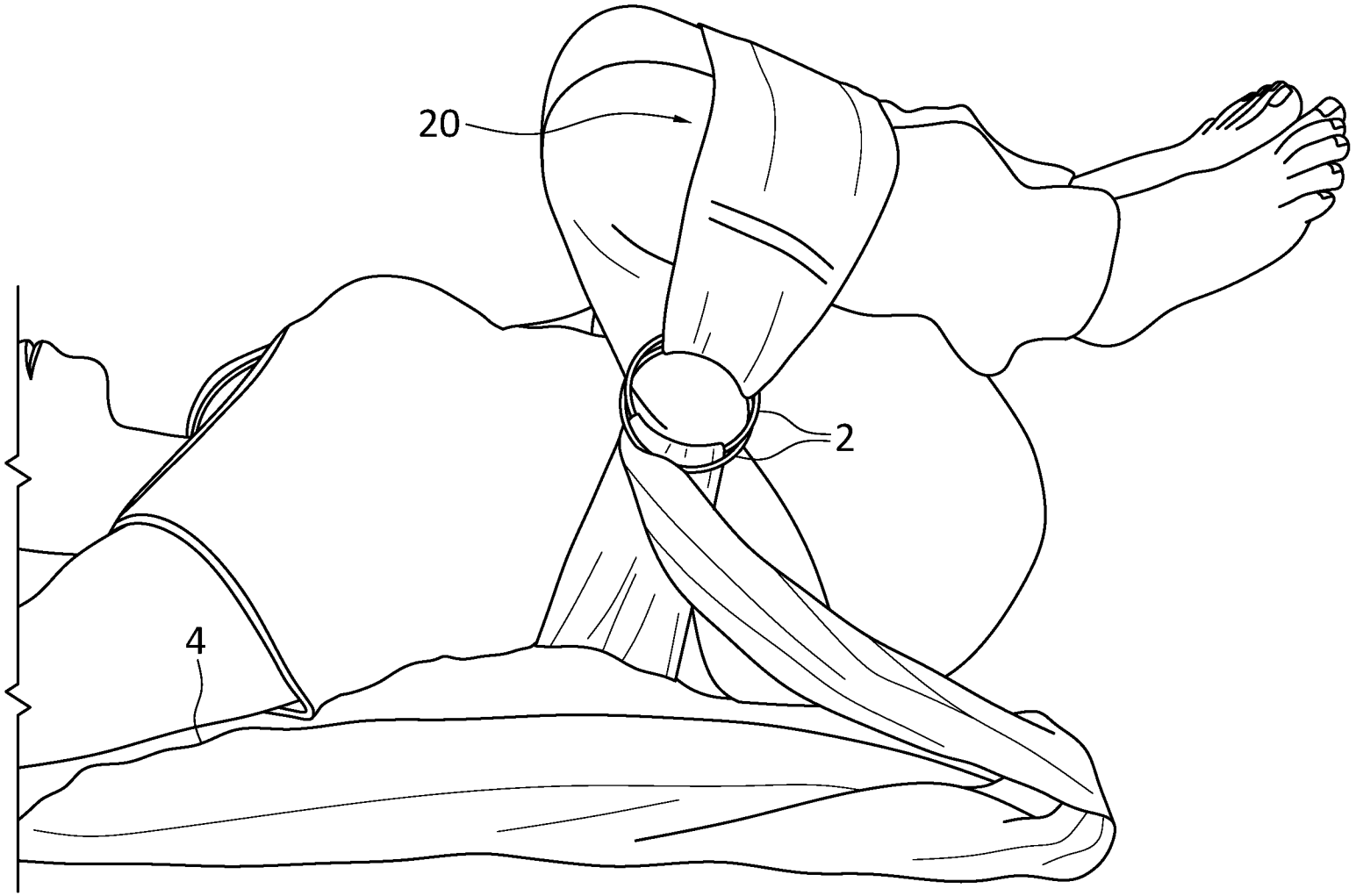
FIGS. 6A through 6E illustrate methods of use of the present invention in the fourth embodiment when performing yoga postures, and the third embodiment in prenatal care.

Referring now to the present invention (20) when used as a method for the fourth embodiment as an aid to practice yoga postures as illustrated in FIGS. 6A through 6E. FIG. 6A shows a practitioner in the knees to chest position, wherein the user lies in a supine position placing the looped cloth apparatus (formed using the instructions previously detailed above) under the mid back and pulls the knees to the chest through the loop. A user's body is encased within the loop and the buckle (2) is on the left or right-side of the user's body between the knees and chest. The buckle (2) is then cinched tight by pulling the tail end (4) and the user relaxes the body.

Figure 6B:
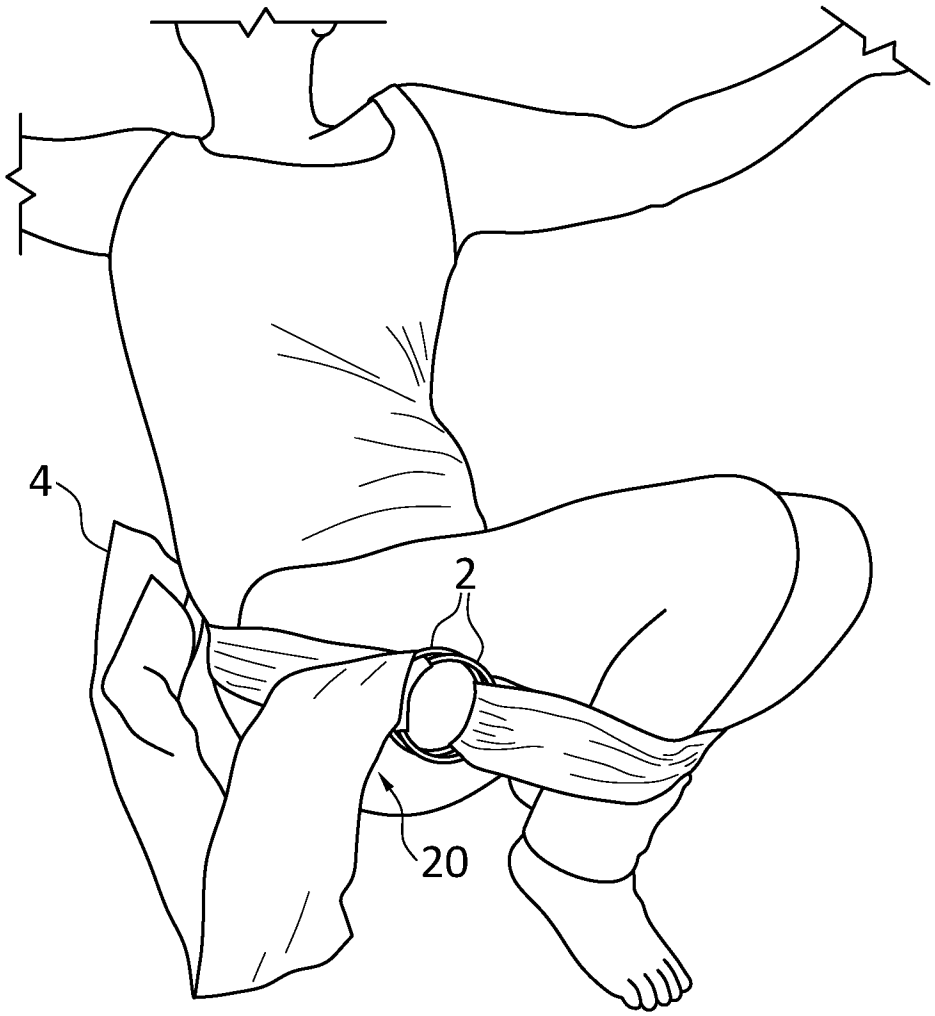

Referring now to FIG. 6B which shows the present invention (20) used as a method to practice the yoga posture: spinal twist with knees to chest. A user begins with the knees to chest in a supine position as described above, then slides the apparatus (20) from the back to under the hips, and from the knees to the mid shin. The apparatus (20) is then tightened with the buckle (2) which comes to rest on the side of the practitioner's legs, in the space between the thigh and calf so as not to pinch a user's skin once twisted. A user then allows the knees to fall to the side of the body in a twist, stretching the opposite side of the torso.

Figure 6C:
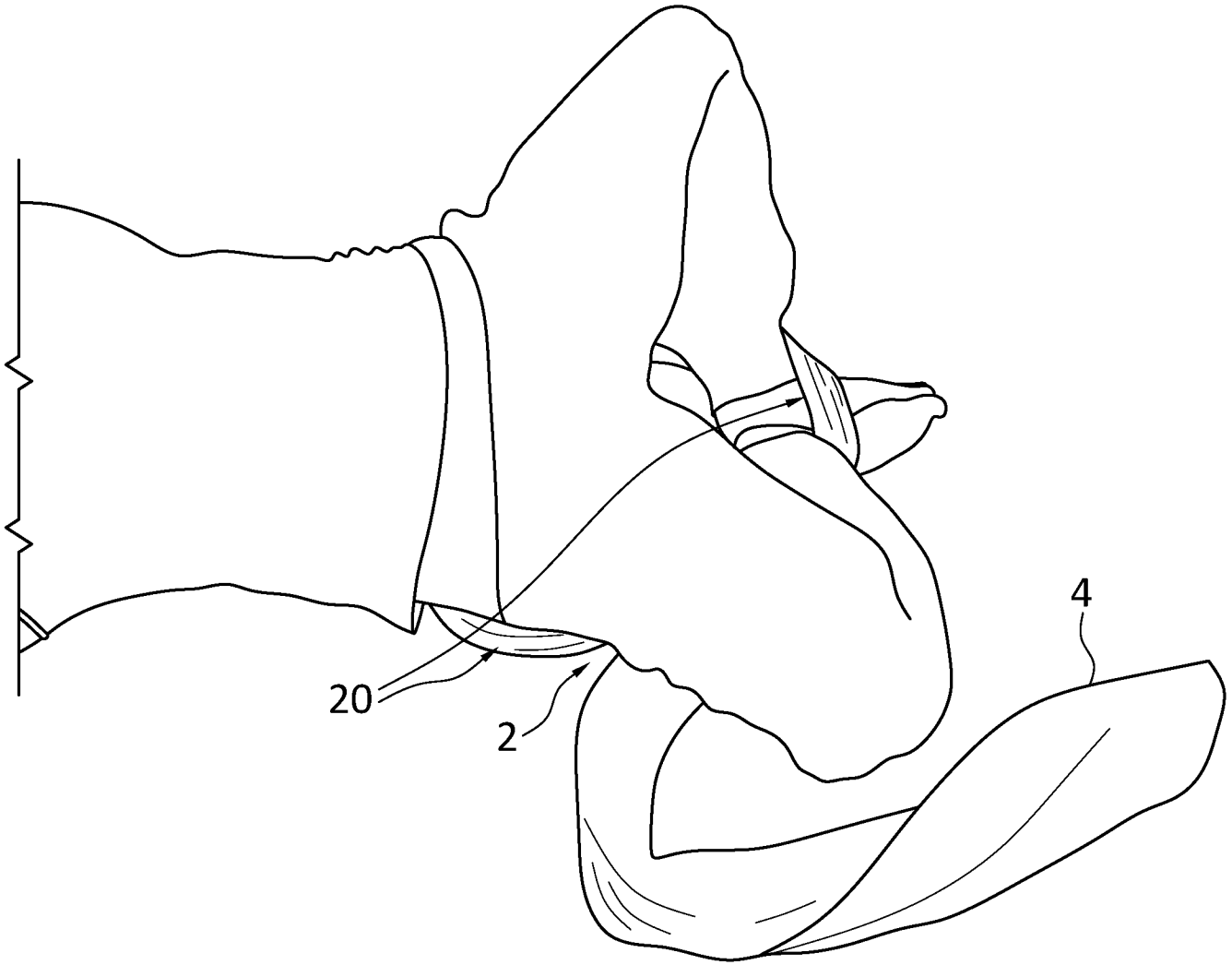

Referring now to FIG. 6C which shows the back support apparatus (20) used as a method to practice the yoga posture: reclined butterfly. A user lies supine with the knees to chest as described previously, and slides the back support apparatus (20) from the back to under the hips and from the shins to the ankles. The user pulls the tail (4) of the apparatus (20) to a comfortable tension and brings the feet to the floor just beyond the buttocks with the knees bent. A user then allows each knee to fall out towards the sides leaving a large diamond shaped space between the groin and legs with the soles of the feet touching. A user's inner thigh and groin muscles are stretched.

Figure 6D:
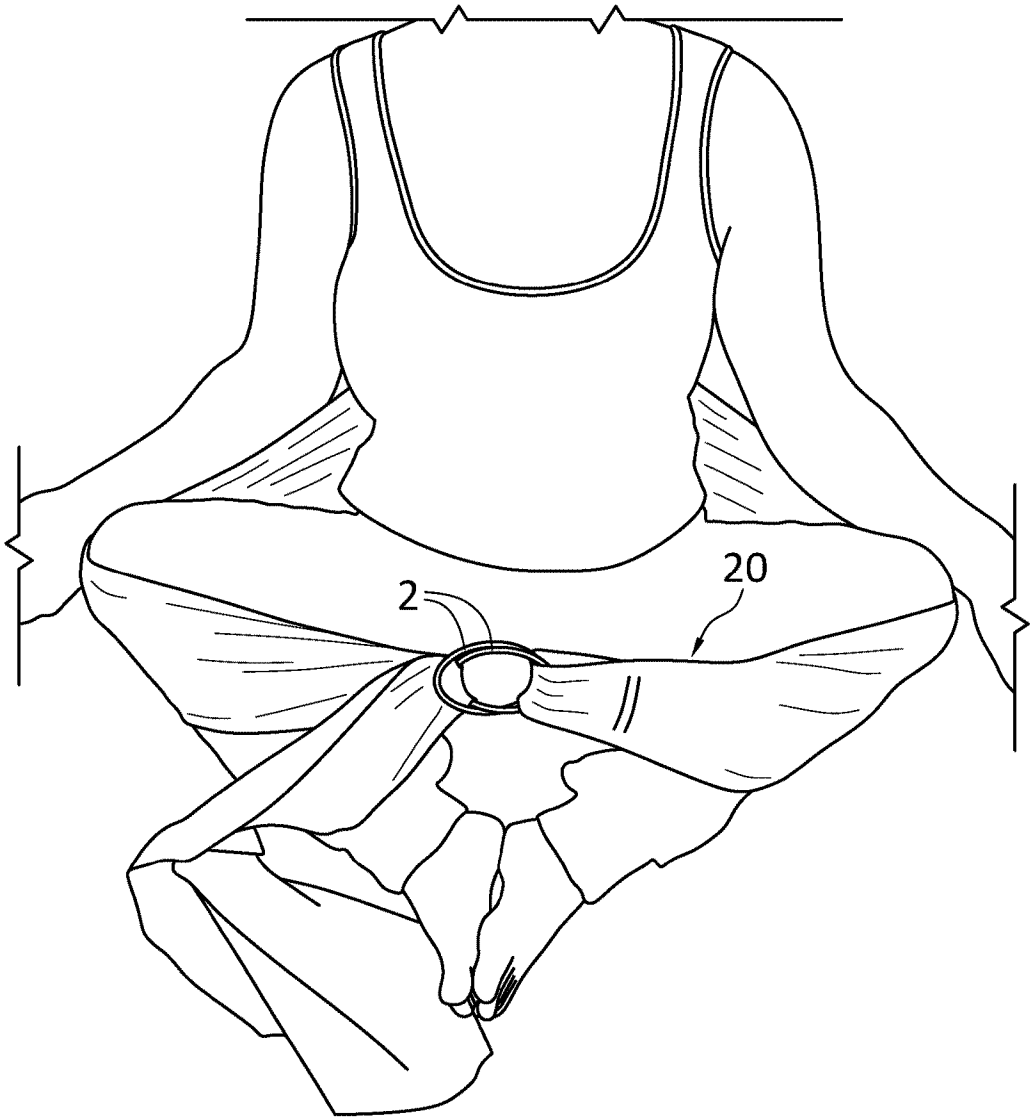

Referring now to FIG. 6D which shows the back support apparatus (20) used as a method to practice yoga in the butterfly position of the fourth embodiment. A user sits inside the back support apparatus (20) formed into a loop as previously described with the buckle in front. The user sits with the soles of the feet together and the knees out to the sides, creating a diamond shaped space between the heels and groin. A user then places the cloth apparatus (20) across the mid back area and over the knees. The buckle (2) is tightened and a user relaxes into the position allowing the back to be supported.

Referring again to FIG. 6D which shows the back support apparatus (20) used as an aid and method for supporting the body in prenatal care as outlined in the third embodiment detailing the present inventions use in preparation for a natural birth. The poSture pushes the uterus forward, stretches the legs and opens the pelvis by stretching the cartilage and ligaments at the sacroiliac joints and the front symphysis pubis bone allowing the pelvic cartilage and ligaments to relax and open. The method of use is described in above.

Figure 6E:
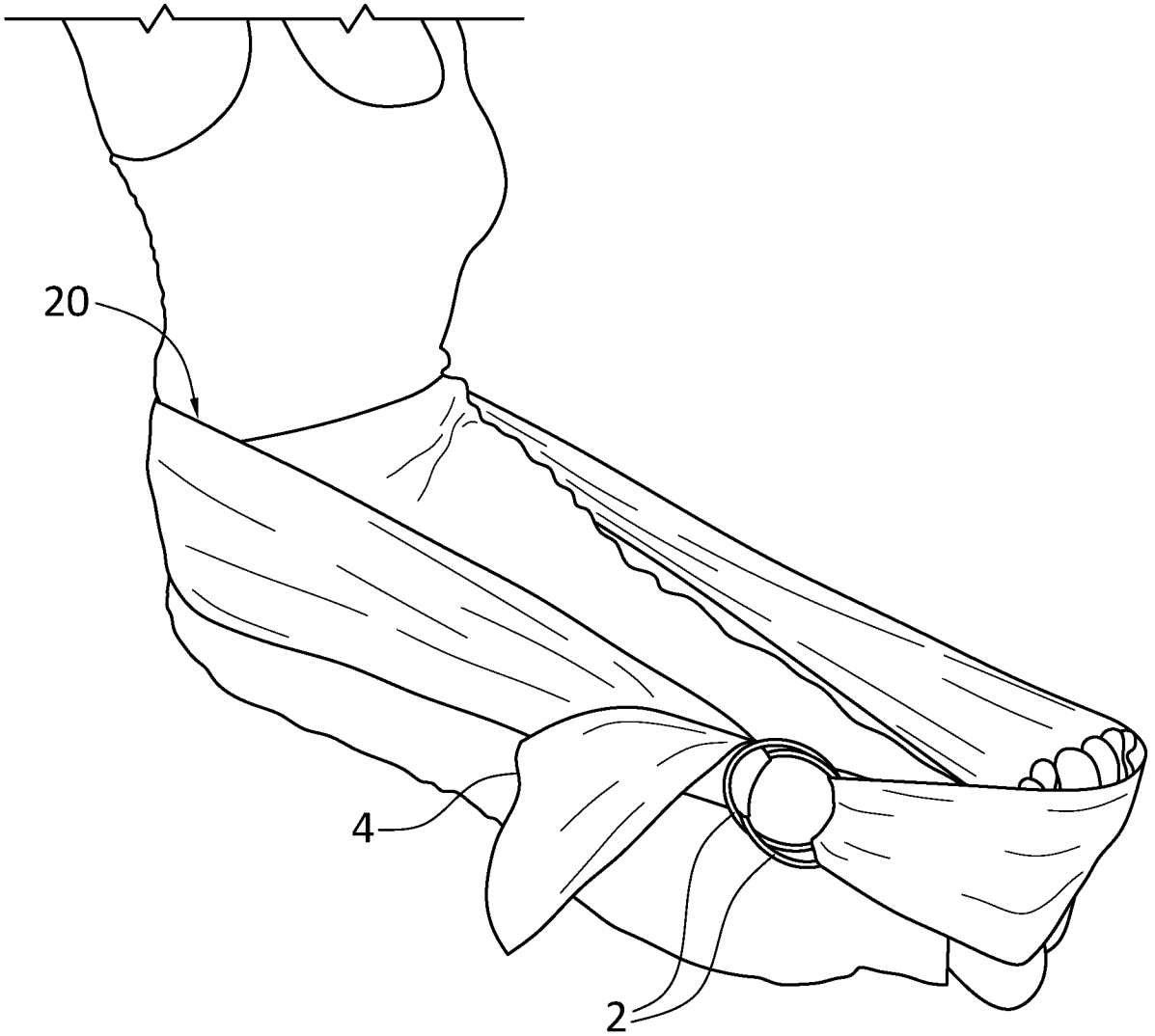

Referring now to FIG. 6E which shows the back support apparatus (20) used as a method to practice yoga in a forward fold position. A user sits inside the looped apparatus with the legs straight out in front of the torso. The looped apparatus is placed around a user's hips and the balls of the user's feet. The buckle (2) is tightened with the tail (4) so the user's feet are supported in a flexed position which stretch the muscles of the backs of the legs. A user may remain in this position while sitting with a straight spine or begin folding forward from the hips.

Figure 7:
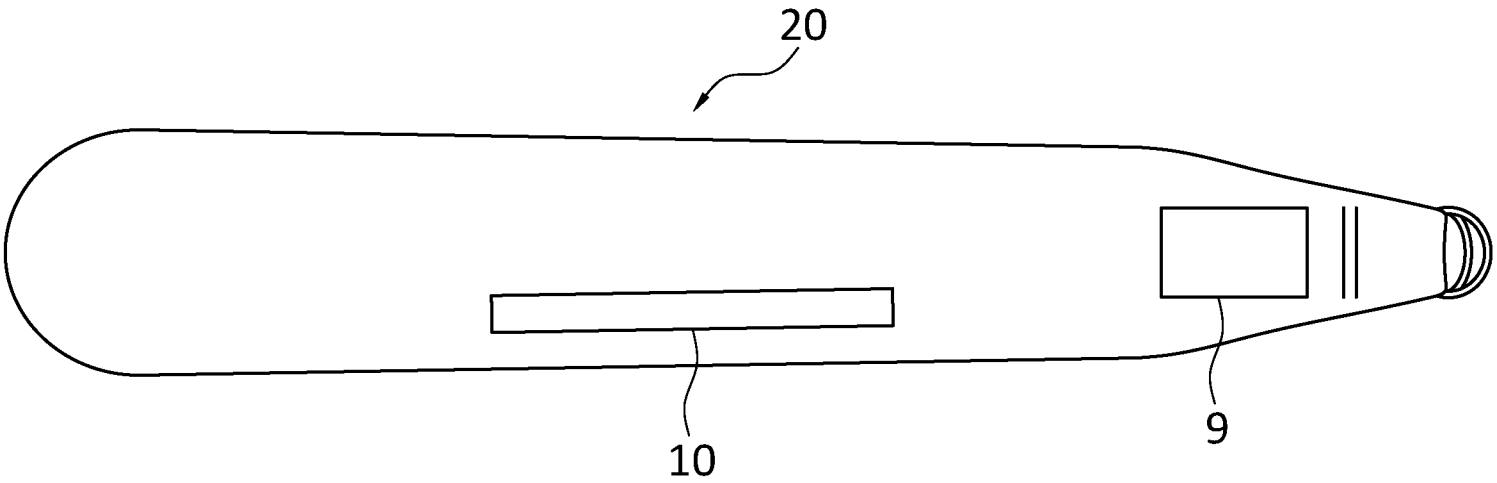
FIG. 7 is an illustration of the present invention with pockets or sleeves.

Referring now to FIG. 7, which illustrates the present invention (20) having pockets (9) for an audio apparatus, keys, cards, healing stones or crystals and/or sleeves (10) for therapeutic packs or poultices. An embodiment may contain none or all of the aforementioned in any arrangement. An embodiment with pockets (9) or sleeves (10) may be comprised of two or more layers of cloth to create pockets (9) by slicing and stitching; however cloth pockets (9) or sleeves (10) may be sewn onto the preferred first embodiment (20). When the cloth is doubled, FIG. 3A is altered so that it mirrors itself, essentially doubling the pattern and stitched together.

The present invention comprised of pockets (9) or sleeves (10) for therapeutic packs may further be comprised of a zipper, Velcro, press seal closure, cloth flap for closure. The pockets (9) and sleeves (10) may be rectangular, square, oblong, round and various sizes are placed along or across the sling and in any quantity, size and/or shape.

Figure 8:
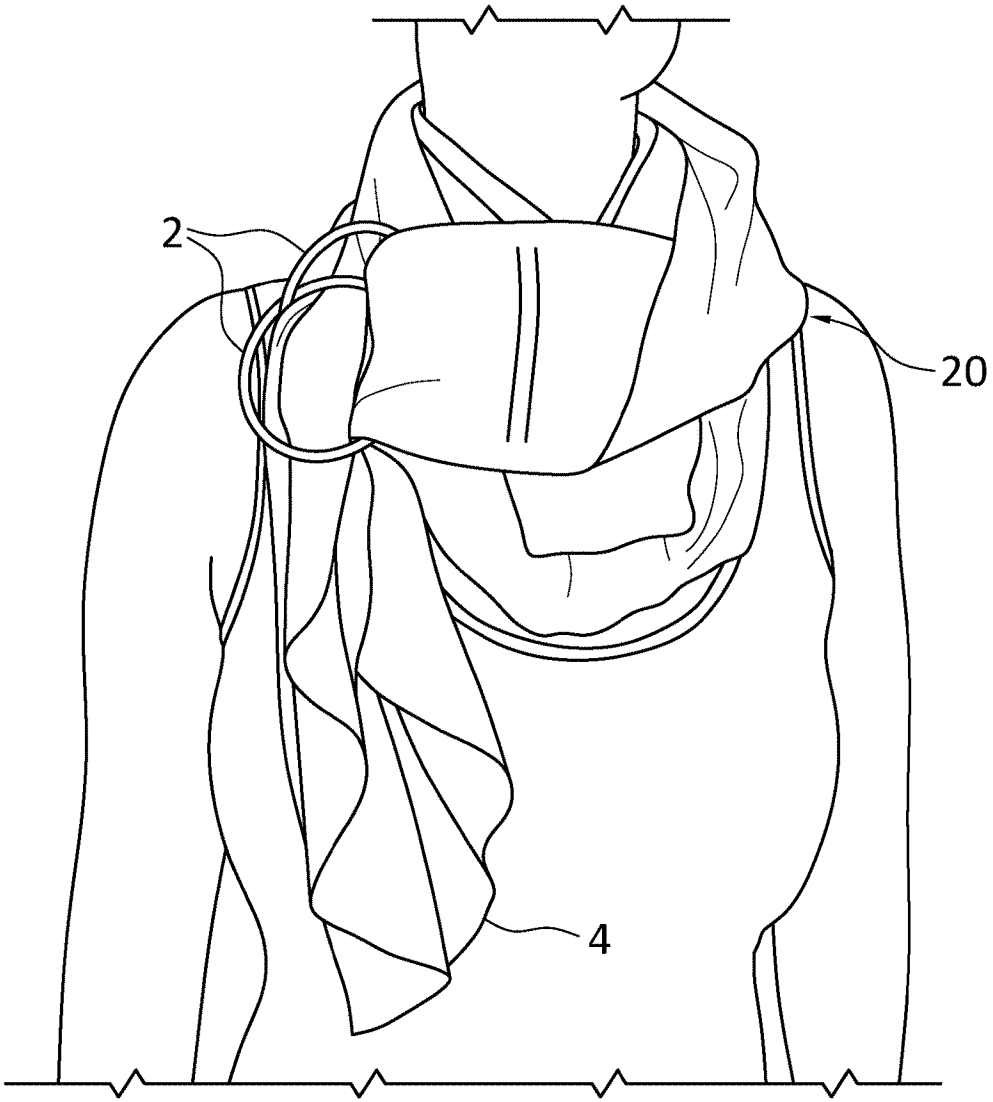
FIG. 8 illustrates the invention of FIG. 1 worn as a scarf.

Referring now to FIG. 8 which illustrates the present invention (20) worn as a scarf to keep the user warm. The apparatus worn as a scarf by weaving the tail end (4) through the buckle (2), approximately 4-6" and looping the cloth around a user's neck 1 or more times depending on the users desired level of comfort.

Figure 9:
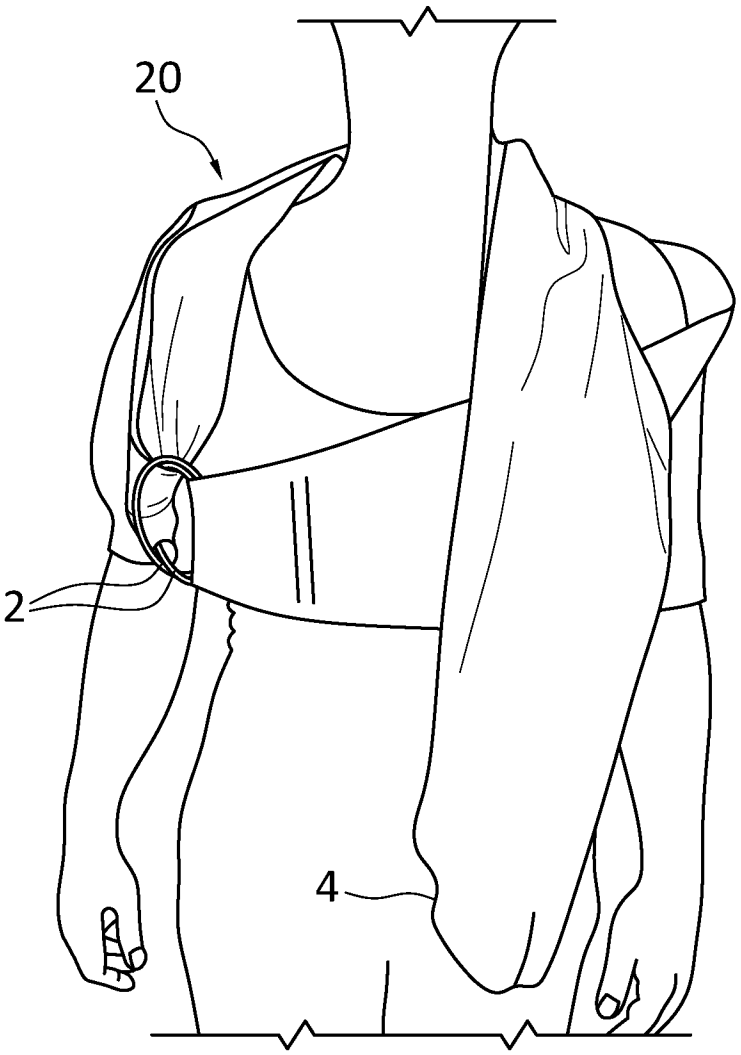
FIG. 9 illustrates the invention of FIG. 1 worn as a shawl.

Referring now to FIG. 9 which illustrates the present invention (20) worn as a shawl to keep the user warm and provide sun protection. The apparatus is draped over a user's shoulders and secured by pulling the tail end (4) through the buckle (2).

Figure 10:
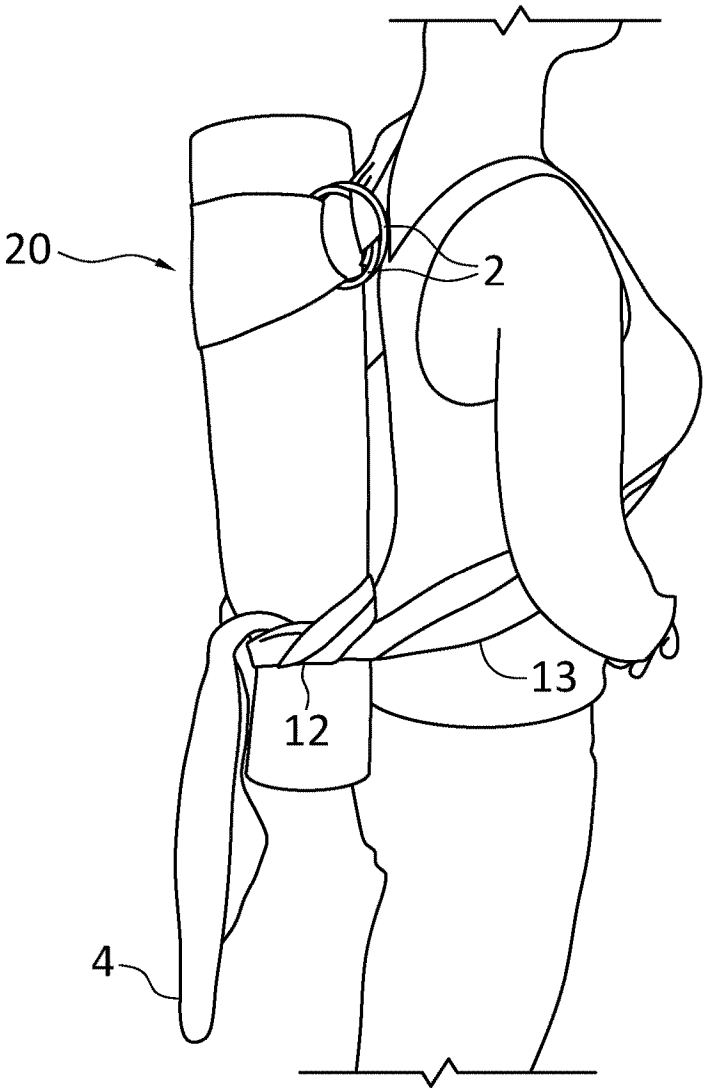
FIG. 10 illustrates the invention of FIG. 1 used as a yoga mat carrier.

Referring now to FIG. 10 which shows the present invention (20) used as a method to carry a yoga mat. The tail (4) passes through the buckle (2) forming a small loop which is placed around one end of the rolled up yoga mat. The tail is then tied (12) around the opposite end of the yoga mat. This creates a strap (13) which can now be worn over a user's shoulder or slung across a user's back.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A back support apparatus comprising:

a length of cloth being fabricated of a single material of woven or knit fibers containing little to no stretch and having a first end, a second end, and a back supporting portion extending between the first end and the second end;

the first end comprising a reinforced portion of the length of cloth wherein a portion of the cloth is folded into a center line of the cloth from each side and stitched together at an edge of the first end; the folded cloth at the first end is folded into the center line again and extended through a buckle, folded over, and secured onto the first end of the cloth;

the second end comprising a tail end of the reinforced length of cloth being configured to be threaded through the buckle to create a resulting loop; and the back support portion having leg engaging sections solely comprised of the reinforced length of cloth, at least one of the leg engaging sections is provided substantially adjacent to the buckle;

wherein the reinforced length of cloth is configured to be looped around knees and back of a single user in a seated position, the second end of the cloth is pulled through the buckle and the resulting loop of the reinforced cloth is tightened as required around the back and knees of the user so as to maintain the user in a seated position with the reinforced length of cloth supporting the back and knees of the user, and the back supporting portion positioned so as to swaddle a substantial portion of the user's mid to low back.

2. The back support apparatus of claim 1 wherein the buckle is one or more of a latch, fastener, locking snap, ring or D-ring.

3. The back support apparatus of claim 1 wherein the cloth is of the following dimensions ranging from 1.5 meters to 3.5 meters in length, and ranging from 20 centimeters to 96 centimeters in width.

4. The back support apparatus of claim 1 in the cloth measures 2.5 meters in length and 41 centimeters in width.

5. The back support apparatus of claim 1 wherein the cloth is rectangular shape with the second end being rounded.

6. The back support apparatus of claim 1 wherein the cloth is in the shape of one of an oval, oblong, square, baguette, tapered, or rounded shape.

7. The back support apparatus of claim 1 wherein the buckle is comprised of one or more of metal, nylon or plastic shapes.

8. The back support apparatus of claim 1 wherein the buckle is formed in one or more of a round, oval, square, oblong or rectangular shape.

9. The back support apparatus of claim 1 wherein the buckle is comprised of two circular aluminum rings.

10. The back support apparatus of claim 1 wherein the buckle is releasable so that the cloth can be tightened by pulling the second end through the buckle or released to ease tension in the cloth.

11. The back support apparatus of claim 1, wherein the buckle is secured to the body with thread, reinforced stitching, latches, marine grade locking snaps, fasteners, or other secure locking mechanism.

12. The back support apparatus of claim 1, wherein a chamber is provided which is adapted to hold therapeutic packs such as herbal compresses, hot or cold packs, rice bag, crystals or other objects as desired.

13. The back support apparatus of claim 12 wherein the chamber is a sleeve provided on the cloth that is adapted to hold therapeutic packs such as herbal compresses, hot or cold packs, rice bag, crystals.

14. The back support apparatus of claim 1, wherein a pocket is provided on the cloth that is adapted to hold therapeutic packs such as herbal compresses, hot or cold packs, rice bag, crystals or other objects as desired.

* * * * *